US005928069A

United States Patent [19]

Glesser

[11] Patent Number: 5,928,069

[45] Date of Patent: Jul. 27, 1999

[54] ONE-PIECE MULTI-ANGLED SHARPENING DEVICE

[75] Inventor: Louis S. Glesser, Golden, Colo.

[73] Assignee: Spyderco, Inc., Golden, Colo.

[21] Appl. No.: 08/833,419

[22] Filed: Apr. 4, 1997

Related U.S. Application Data

[63] Continuation-in-part of application No. 29/064,777, Jan. 10, 1997.

[51] Int. Cl.[6] ..... B24D 15/00

[52] U.S. Cl. ..... 451/523; 451/524

[58] Field of Search ..... 451/526, 527, 451/557, 556, 558, 523, 524, 45; 83/174; 76/82, 82.2, 86

[56] References Cited

U.S. PATENT DOCUMENTS

| | | | |
|---|---|---|---|
| D. 285,042 | 8/1986 | Sparks . | |
| D. 297,209 | 8/1988 | Cohen . | |
| D. 318,782 | 8/1991 | Lebeau . | |
| D. 326,989 | 6/1992 | Button et al. . | |
| 530,613 | 12/1894 | Berkman . | |
| 572,190 | 12/1896 | Brinkman . | |
| 578,440 | 3/1897 | Beaudin . | |
| 620,050 | 2/1899 | Poindexter . | |
| 665,895 | 1/1901 | Foster . | |
| 942,959 | 12/1909 | Emery . | |
| 2,415,367 | 2/1947 | Pavlovic | 451/524 |
| 2,481,309 | 9/1949 | Gunnarson | 451/524 |
| 2,674,072 | 4/1954 | Lohmann . | |
| 2,885,836 | 5/1959 | Robitaille . | |
| 3,871,141 | 3/1975 | Bonapace | 451/523 |
| 3,894,362 | 7/1975 | Graves . | |
| 3,942,394 | 3/1976 | Juranitch | 451/557 |
| 4,228,703 | 10/1980 | Moss . | |
| 4,231,194 | 11/1980 | Glesser . | |
| 4,272,925 | 6/1981 | Graves . | |
| 4,450,653 | 5/1984 | Fletcher . | |
| 4,799,335 | 1/1989 | Battocchi . | |
| 4,912,885 | 4/1990 | Bonapace . | |
| 5,040,435 | 8/1991 | Millman . | |
| 5,594,966 | 1/1997 | Goldman | 451/524 |

*Primary Examiner*—Timothy V. Eley
*Assistant Examiner*—Derris H. Banks
*Attorney, Agent, or Firm*—Sheridan Ross P.C.

[57] ABSTRACT

A method and apparatus for sharpening a knife, scissors or other tool using a multi-angled sharpening device. The apparatus generally comprises a one-piece support structure with abrasive opposing legs which can be modulated between first and second sharpening positions to sharpen the opposing surfaces of a blade. Alternatively, the apparatus can be supported on either the first or second leg to sharpen scissors on the opposing leg.

23 Claims, 8 Drawing Sheets

ONE-PIECE MULTI-ANGLED SHARPENING DEVICE

This patent application is a Continuation-in-Part Application of U.S. patent application Ser. No. 29/064,777 having a filing date of Jan. 10, 1997.

FIELD OF THE INVENTION

This invention relates to sharpening apparatus and in particular to a method and apparatus for sharpening a knife, scissors, chisel or other hand held tool using a multi-angled sharpening device.

BACKGROUND OF THE INVENTION

Sharpening devices such as whetstones, grinding wheels, files and "V" shaped "crock sticks" have previously been utilized by sportsmen, carpenters and homeowners to sharpen knives, scissors, chisels, and other tools which require a finely honed edge to properly function. However, the aforementioned devices are typically capable of sharpening only one specific knife or tool, are too large or cumbersome to be portable, and often have multiple components which may become lost during transportation and/or use.

Furthermore, many of the aforementioned tools are not safe to use based on the geometric configuration or position of the tool and/or knife during sharpening. For example, certain sharpening devices require that the cutting edge of the knife or scissors be drawn directly towards the user's hand or body, thus enhancing the likelihood that the user may be cut during the sharpening process.

Finally, many of the aforementioned devices are expensive to manufacture and assemble as a result of the multiple components used therein. Thus, they are difficult to market and sell in competitive wholesale or retail markets.

SUMMARY OF THE INVENTION

It is therefore an object of the present invention to provide a lightweight, portable sharpening device which can be used to sharpen a multiplicity of objects such as knives, scissors and chisels by providing a variety of different sharpening angles on a hand held apparatus. The predetermined angles are oriented to allow the device to be easily positioned to provide optimum sharpening angles for numerous tools without requiring the changing of parts or modification of the sharpening device. It is a further object of the present invention that the device comprise one piece without moving parts to prevent loss of individual components. Further, the geometric configuration of the tool during use is oriented in a safe position to prevent users from being inadvertently cut.

It is yet another object of the invention that the device be inexpensive to manufacture yet constructed of a durable wear resistant material and not susceptible to being broken or damaged during use or transportation. To reduce manufacturing costs the sharpening device may be constructed entirely from an abrasive material such as a ceramic. Alternatively, the sharpening device may be constructed of a non-abrasive substrate and coated on the sharpening surfaces with an abrasive material conducive to sharpening both metallic and non-metallic objects.

Accordingly, a multi-angled sharpening device is provided which in one embodiment comprises a first leg and a second leg of substantially equivalent lengths which are integrally interconnected to a base. The upper ends of the legs may meet at an apex wherein the sharpening device is substantially triangular shaped or the upper ends may be connected by a handle of any variety of geometric configurations in another embodiment. In either embodiment the first and second legs are oriented with the upper ends angled inwardly at a predetermined first angle $\alpha$ as measured in relation to an imaginary vertical plane.

The base of the sharpening device has a geometric configuration which permits the sharpening device to be modulated between a first sharpening position and a second sharpening position. In the first sharpening position the sharpening device is supported on a projection extending downward proximate to the midpoint of the base and at a first end where the first leg is interconnected to the base. In this position a blade of a knife can be honed along the second leg of the sharpening device.

Likewise, the sharpening device can be modulated to a second sharpening position wherein the sharpening device is supported by the projection extending downward from the base and a second end where the second leg is interconnected to the base. In this position the first leg is now positioned at an optimal angle to permit the opposing edge of a blade to be honed on the exterior surface of the first leg of the sharpening device. Thus, the total sharpening angle of the first and second legs during use are determined by the composite sum of the first angle a defined by the orientation of the first and second legs and a second angle $\theta$ defined by the length of the projection extending downwardly from the bottom of the base.

In another embodiment of the present invention the projection which extends downward from the base is adjustable. This feature allows the second angle to be modified to permit the greatest degree of flexibility to alter the angle by which a blade will be sharpened. Thus, a blade can be honed at a composite third angle of between about 15 degrees and 30 degrees depending on the length of the projection extending from the base.

To facilitate the sharpening of scissors which generally have beveled edges of between about 0 and 85 degrees, the sharpening device may be supported on a substantially flat surface either by the first leg or the second leg as opposed to the projection extending from the base. In this position the scissors may be sharpened on the opposing leg which has an abrasive exterior surface for sharpening the cutting edge of the scissor blades.

Furthermore, to facilitate the sharpening of chisels or other hand tools requiring a beveled edge, the sharpening device has at least one substantially planer surface with an abrasive coating to permit the honing and sharpening of these types of objects. Thus, the basic configuration of the sharpening device with multiple angles allows the sharpening of knives, scissors and hand tools such as chisels without interchanging different components.

Additionally, to allow the sharpening of fish hooks, broadheads and other similar shaped articles, the sharpening device may have a "V-shaped" groove. The groove in one embodiment extends essentially from near the apex of the triangular shaped device to the midpoint of the base. However, as appreciated by one skilled in the art, the location of the "V-shaped" groove may be positioned at any number of locations on the front or rear surface of the sharpening device.

DETAILED DESCRIPTION OF THE PREFERRED EMBODIMENT

Accordingly, a multi-angled sharpening device is provided which may be used to sharpen a multiplicity of hand tools including knives, scissors and chisels. The device may additionally include an angle modulation component which permits the second angle of the sharpening device to be quickly modified. Preferably the sharpening device is comprised of one integral piece, thus eliminating numerous components and the likelihood of loss and increased manufacturing costs.

Figure 1:
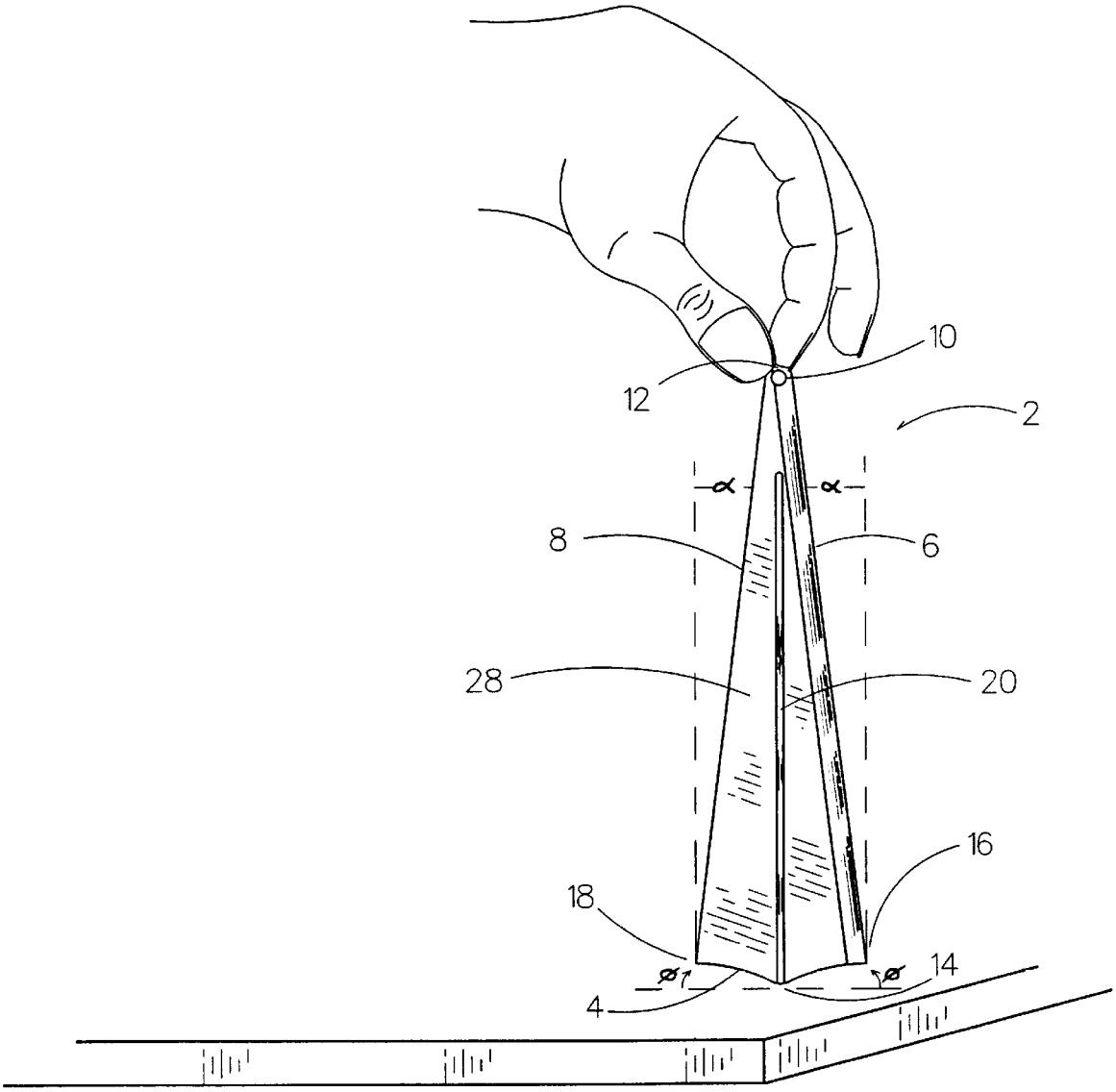
FIG. 1 is a front elevation view of the sharpening device being held in a neutral position on a substantially flat surface.
Figure 7:
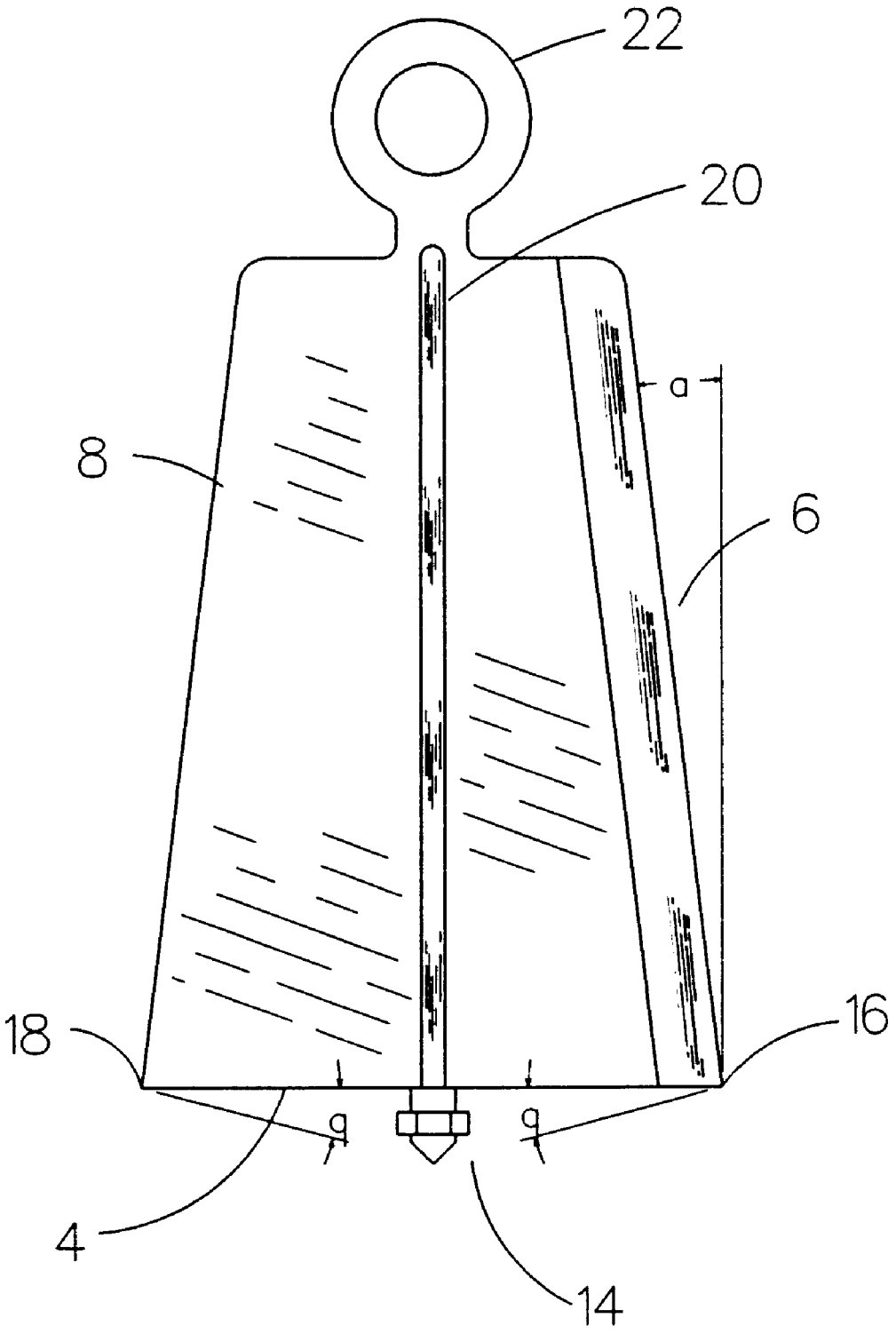
FIG. 7 is an alternative embodiment of the sharpening device of FIG. 1 showing an adjustable projection member extending from the base.

Referring now to the drawings, FIG. 1 is a front elevation view of the sharpening device shown positioned in a neutral position on a flat surface such as a table top. As identified in the drawings, the sharpening device generally consists of a triangular shaped sharpening member 2 comprised of a first leg 6 and a second leg 8 which are interconnected on an upper end to an apex 12 and on a lower end to a support base 4. The first leg is interconnected to the support base at a first end 16 while the second leg is interconnected to the support base 4 at a second end 18. The support base may further include an angle modulation member 14 which projects downwardly from the base proximate to the midpoint of the first end 16 and the second end 18. Although the sharpening device is preferably comprised of one integral component, in another embodiment the geometric shape of the invention described herein could be accomplished by interconnecting a plurality of individual component members. As shown in FIG. 7, the upper ends of the first leg and the second leg are tilted inwardly to define a specific first angle $\alpha$ as measured from an imaginary vertical plane extending upwardly from the first end 16 and second end 18. This first angle $\alpha$ is generally between about 5 degrees and 15 degrees and more preferably 6.25 degrees.

Referring again to FIG. 7, a second angle $\theta$ is generated between the angle modulation means 14 and the first end 16 and second end 18. This angle is measured from a horizontal plane of reference and is directly dependent on the total length of the angle modulation means 14 which extends downwardly from the base of the sharpening device. Although FIG. 7 shows an angle modulation means of a specific geometric shape, any configuration which allows the base of the sharpening device to be tilted in a rocking motion between a first sharpening position (FIGS. 2–3 ) and a second sharpening position (FIGS. 4–5 ) is sufficient. Thus, depending on the length of the angle modulation means, the second angle $\theta$ may be changed preferably between about 5 degrees and 25 degrees and more preferably 13.75 degrees.

As further seen in FIG. 1, a V shaped groove 20 may be operably positioned within the surface of the sharpening device 2 to allow for the sharpening of fish hooks, arrow broadheads, and other similar objects requiring a sharp edge. Preferably the "V" shaped groove has a radius at the bottom of the "V" of about 0.040 and each of the legs of the "V" are angled inwardly at an angle of between about 10–15 degrees. Although in the embodiment shown the "V" shaped groove extends almost the entire length of the front surface of the sharpening device, the groove may have any operable length and be positioned on either the front or rear planar surfaces of the sharpening device.

Additionally, the sharpening device may comprise a planer abrasive sharpening surface 28 to allow a chisel or other similar device to be honed. As appreciated by one skilled in the art, this planar surface may be positioned on either the front or back of the sharpening device or both and is accomplished by providing an abrasive on any planar surface of the sharpening device.

Figure 2:
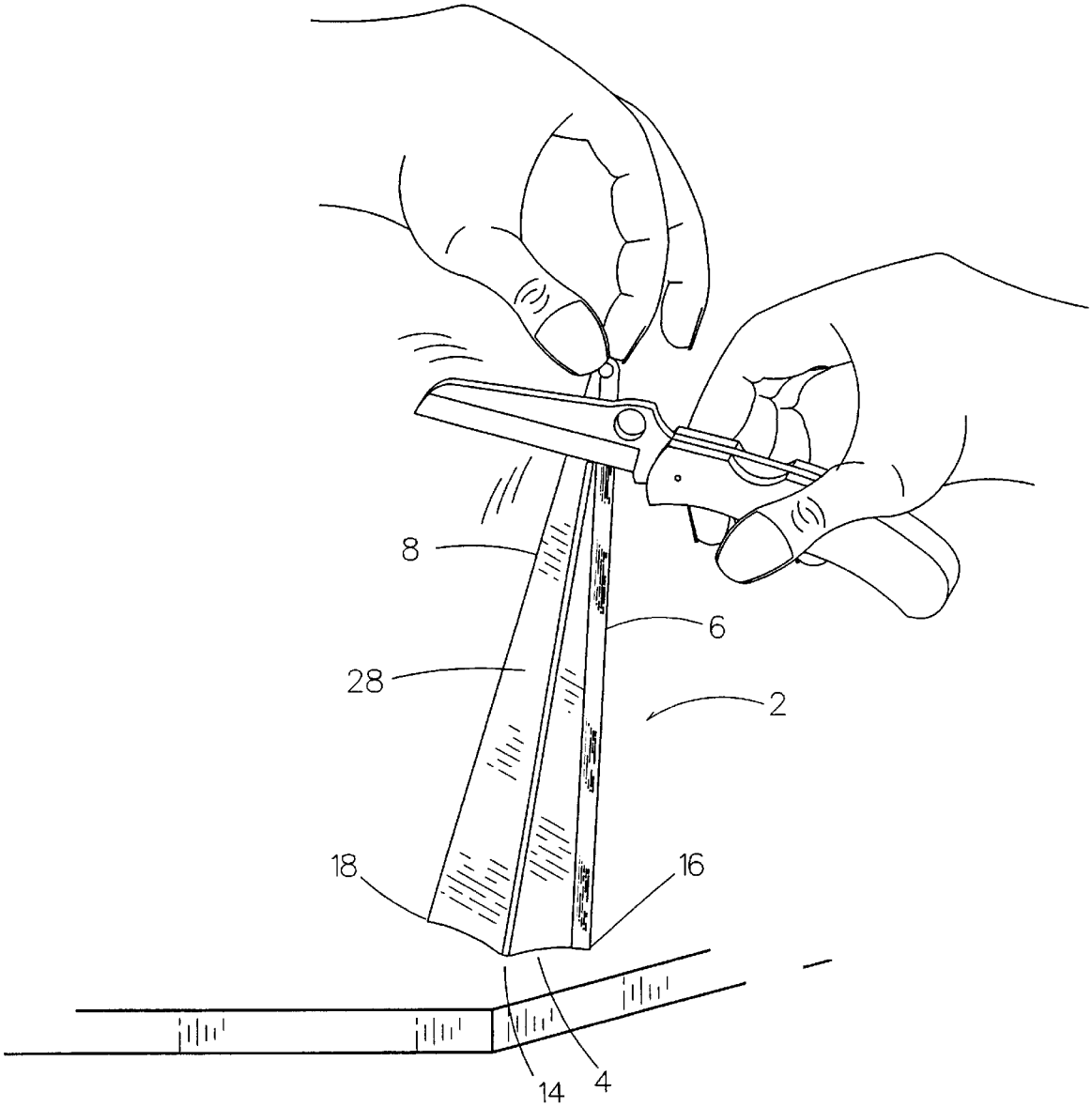
FIG. 2 is a front elevation view of the sharpening device oriented in a first position and a knife blade being drawn along the second leg.
Figure 3:
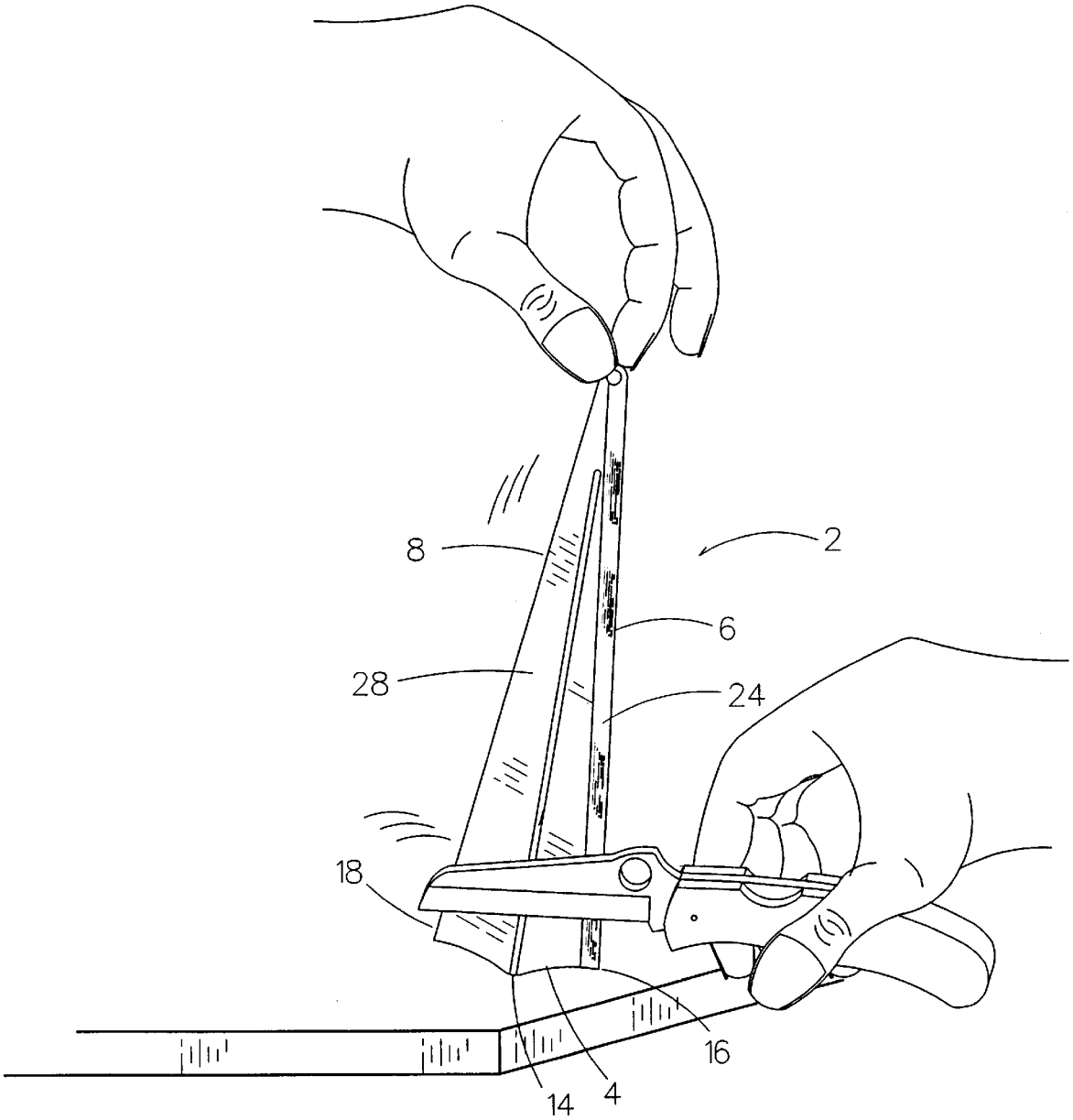
FIG. 3 is a front elevation view of the sharpening device showing the knife blade positioned at the bottom of a sharpening stroke.

Referring now to FIGS. 2–3, the sharpening device of FIG. 1 is shown in use. As seen in FIG. 2, in a first position the knife sharpening device is tilted in a right-hand direction wherein the device is supported by the angle modulation member 14 and the first end 16. The user of the sharpening device then guides the knife blade from the top of the second leg 8 downward towards the second end 18. To complete the knife sharpening stroke as seen in FIG. 3, the knife blade is positioned at the bottom of the second leg 8 near the second end 18, thus sharpening one edge of the knife blade.

Figure 4:
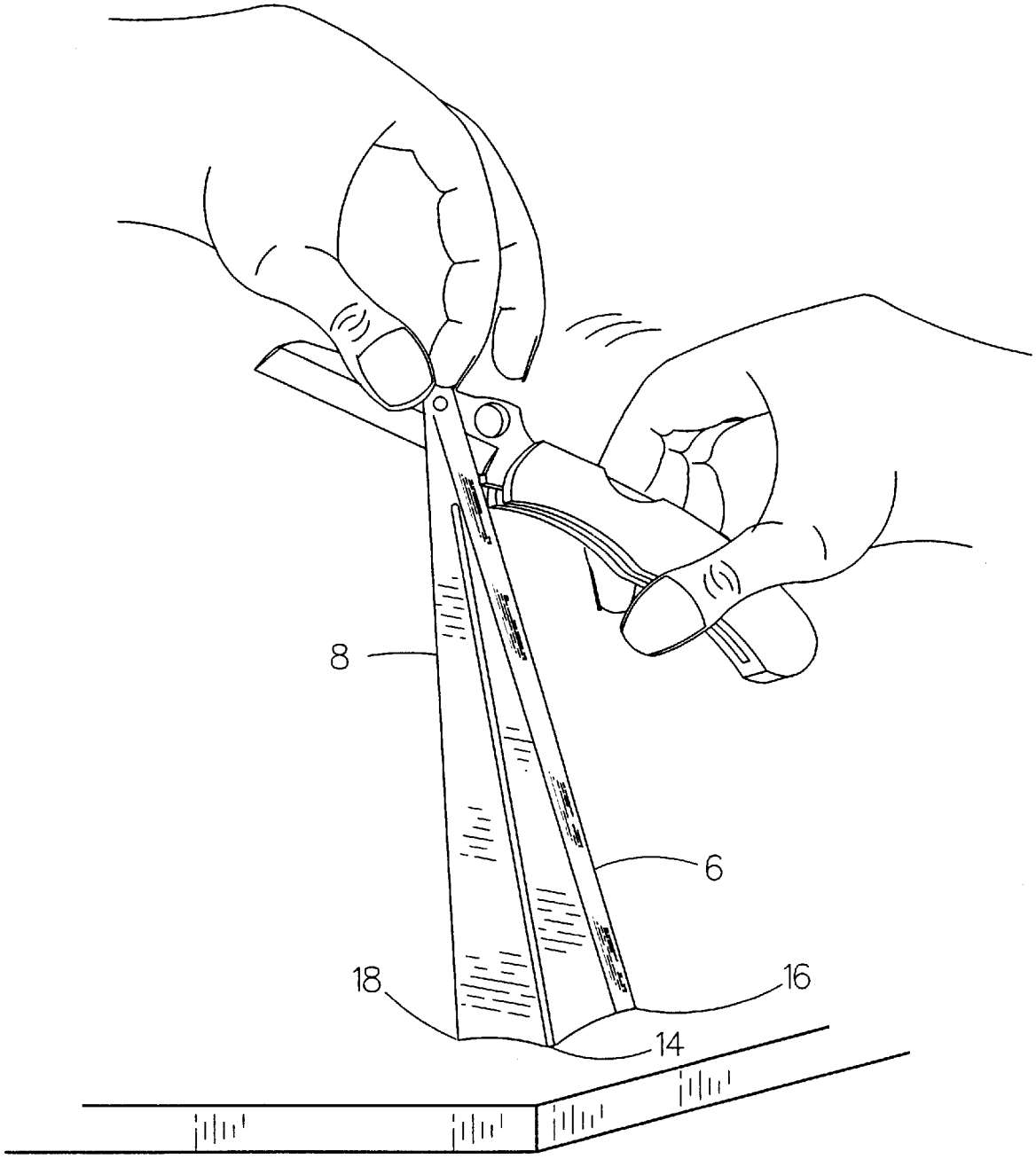
FIG. 4 is a front elevation view of the sharpening device oriented in a second position and a knife blade being drawn from the top of the first leg.
Figure 5:
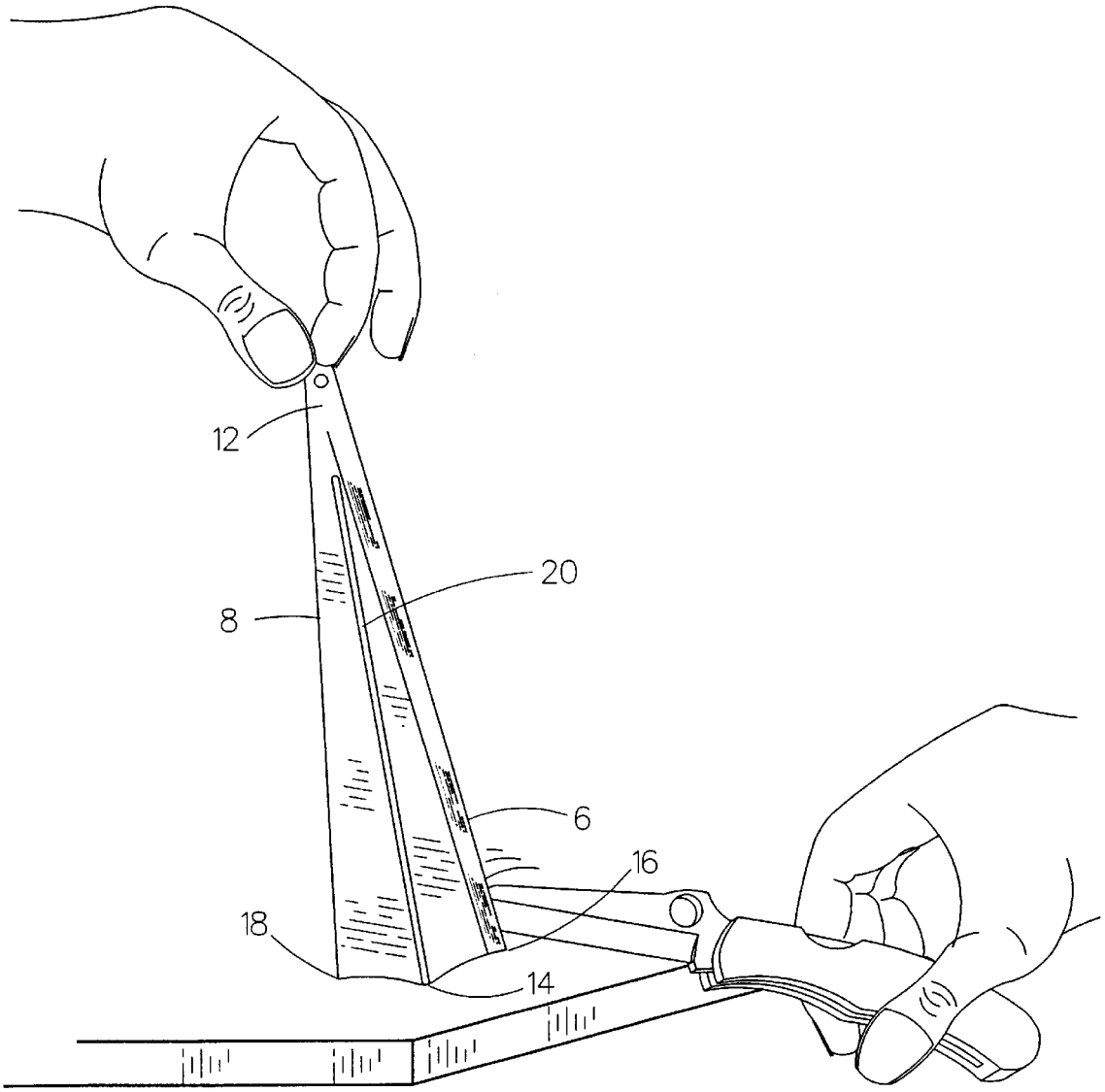
FIG. 5 is a front elevation view of the sharpening device in FIG. 4 with the knife blade positioned at the bottom of a sharpening stroke.

Referring now to FIGS. 4–5, the sharpening device 2 is tilted in a left hand direction to a second sharpening position wherein the device is supported on the angled modulation member 14 and the second end 18. The knife blade is then positioned near the top of the first leg 6 and the knife blade is drawn downwards towards the first end 16 as seen in FIG. 5. Thus, the opposing edge of the knife blade is now sharpened during the down stroke of the knife blade which is in contact with the exterior surface of the first leg 6.

Figure 6:
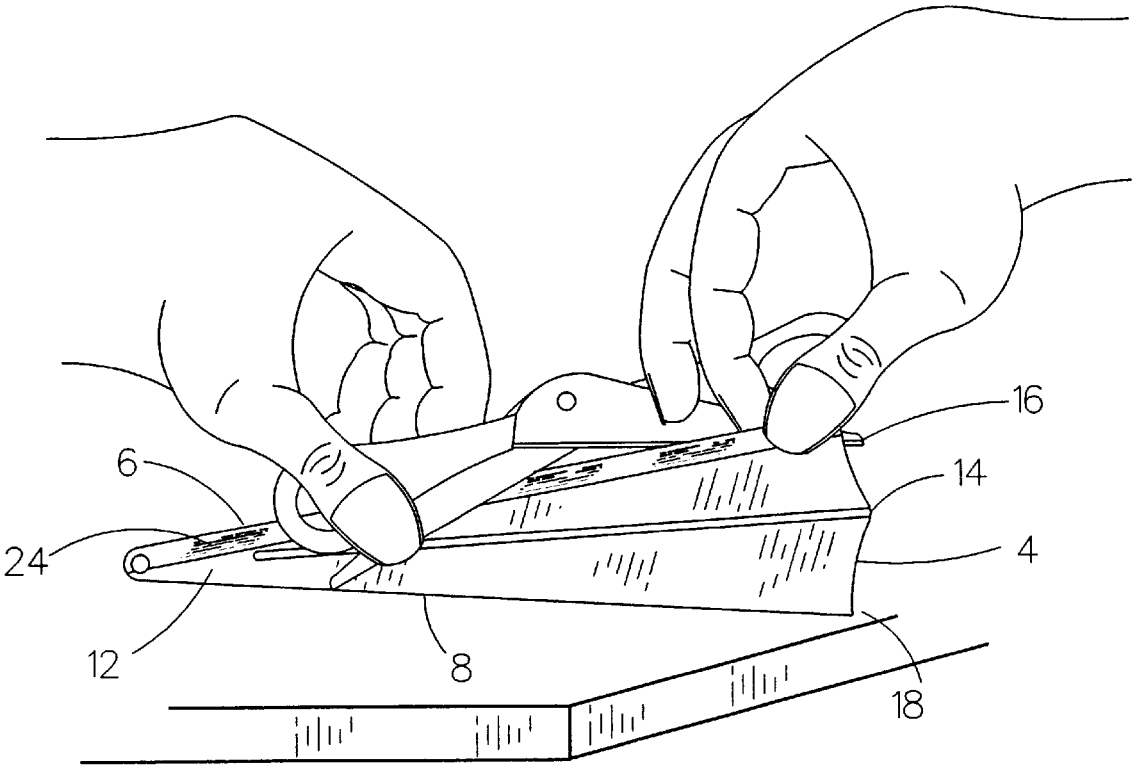
FIG. 6 is a front elevation view of the sharpening device of FIG. 1 resting on the second leg and a pair of scissors positioned for sharpening on the first leg.

Referring now to FIG. 6, the one-piece angled sharpening device may also be used to sharpen scissors, tin snips and other tools with similar geometric cutting members. As seen in use, the sharpening device is positioned on either the first leg 6 or the second leg 8. The scissor blade is then run along the opposing leg outer surface which is generally at an angle of about 12° as a result of the first angle $\alpha$ of the first and second legs. The opposing edge of the scissors may then be sharpened by resting the sharpening device on the opposing leg, wherein the scissor cutting edge is drawn along the opposing leg.

Referring now to FIG. 7, an alternative embodiment of the knife sharpening device of FIG. 1 is shown. As seen, rather than the triangular shaped sharpening device shown in FIG. 1, a structure resembling a trapezoid having opposing legs of equal length is shown. Preferably this geometric shape also includes a handle 22 extending from the top of the sharpening device. As appreciated by one skilled in the art, the actual shape of the sharpening device and position and shape of the handle 22 may have any variety of geometric configurations. The critical factor however, is the first angle $\alpha$ which is measured from an imaginary vertical plane and the second angle θ which is measured from an imaginary horizontal plane and is dictated by the length of the angle modulation means as shown in FIG. 7.

In a preferred embodiment, the angle modulation means 14 may be adjustable with the base 4 which allows the angle modulation means 14 to be extended or retracted as desired to change the total length of the angle modulation means. The adjustment may be made by the use of a threaded coupling, screw mechanism, ratcheting device or other similar quick-connect mechanism known in the art. This feature allows the second angle θ to be quickly modified which effectively changes the composite third sharpening angle applied to the knife as the sharpening device is modulated between a first sharpening position and a second sharpening position. Preferably, the angle modulation means 14 includes a pointed surface which allows the device to be firmly embedded into a flat surface such as a piece of wood or other similar device.

The second angle θ is generally between about 5 and 25 degrees, while the first angle α is generally between 5 and 15 degrees. Thus, when the device is tilted to either the first sharpening position or the second sharpening position the composite sharpening angle applied to the knife blade is θ plus a resulting in a composite third angle of between about 15 and 30 degrees. Preferably the first angle is 6.25 degrees, while the second angle is 13.75 degrees, thus the composite third angle is 20 degrees. With the adjustable angle modulation means 14 shown in FIG. 7, a user of the knife sharpening device may custom tailor the composite third sharpening angle applied to the blade during sharpening between 15 degrees and 30 degrees.

Figure 8:
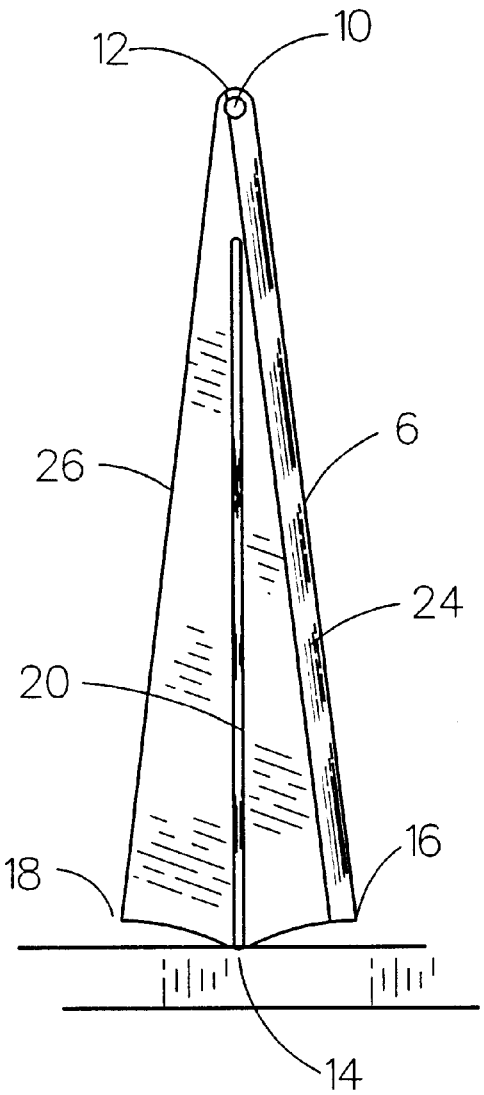
FIG. 8 is a front elevation view of the sharpening device in FIG. 1 in a neutral position.

Referring now to FIG. 8, a front elevation view of the knife sharpening device of FIG. 1 is provided which shows the components previously described. These components include an apex 12 and a first leg 6 and a second leg 8 interconnected to a base 4. The base in this embodiment comprises a non-adjustable angle modulation means 14, a first end 16 and second end 18. Furthermore, a V-shaped groove 20 is provided to facilitate the sharpening of fish hooks, broadheads and other similar devices.

Figure 9:
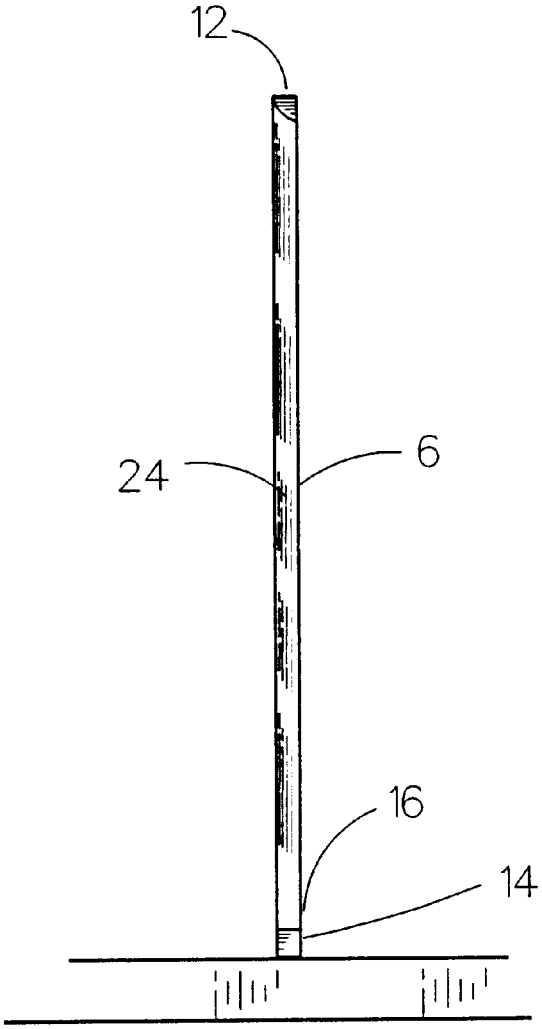
FIG. 9 is a right elevation view of the sharpening device shown in FIG. 8.

Referring now to FIG. 9, the one-piece angled knife sharpening device of FIG. 8 is shown from a right elevational view. As seen, the front and back surface of the device is substantially flat which provides a planer sharpening surface 28 to allow a chisel or other similar tool to be beveled and honed at the preferred angle of the user.

In a preferred embodiment the sharpening device is comprised of an abrasive ceramic material such as alumina with a hardness of at least about 9.2 as measured on Mohs' hardness scale. Alternatively, the substrate may be comprised of a non-abrasive material and coated on sharpening surfaces with an abrasive material such as a carbide or diamond grit material.

As seen in the drawings, the method for using the sharpening device is achieved by the user first grasping the upper portion of the sharpening device and tilting the device to a first sharpening position, wherein either the first or second leg is oriented upwardly for use. The user then draws a first cutting edge of a knife blade across the exposed leg of the sharpening device. After the completion of 1–10 strokes, the sharpening device is tilted from a first sharpening position to a second sharpening position, wherein the opposing leg is angled upwardly for use. The user then draws a second cutting edge of a knife blade downward across the leg of the sharpening device 1–10 strokes until the second cutting edge of the knife blade is sufficiently sharp. Thus, by modulating the sharpening device between the first and second sharpening positions, and alternatively drawing the cutting blade of a knife end downward along the exposed legs of the sharpening device, a knife blade may be efficiently and effectively sharpened.

While various embodiments of the present invention have been described in detail, it is apparent that further modifications and adaptations of the invention will occur to those skilled in the art. However, it is to be expressly understood that such modifications and adaptations are within the spirit and scope of the present invention. For clarity, the numbering of the various components identified in the figures are provided herein.

| Number | Component |
|---|---|
| 2 | Sharpening device |
| 4 | Base |
| 6 | First leg |
| 8 | Second leg |
| 10 | Lanyard hole |
| 12 | Apex |
| 14 | Angle modulation member |
| 16 | First end |
| 18 | Second end |
| 20 | V-Shaped groove |
| 22 | Handle |
| 24 | First leg beveled edge |
| 26 | Second leg beveled edge |
| 28 | Planer sharpening surface |

What is claimed is:

1. A one-piece multi-angled sharpening device, comprising:

an apex interconnected to a base at a first end by a first leg and at a second end by a second leg, said first and second legs having substantially equivalent lengths, said base further comprising angle modulation means, wherein said sharpening device may be pivoted on said base between a first sharpening position and a second sharpening position to sharpen opposing sides of a blade on an exterior surface of each of said first leg and said second leg.

2. The sharpening device of claim 1, wherein said first leg and said second leg intersect an imaginary vertical plane at said first and said second ends to define equivalent first angles.

3. The sharpening device of claim 2, wherein said first angle is between about 5 degrees and 15 degrees.

4. The sharpening device of claim 1, wherein said exterior surface of each of said first leg and said second leg comprises an abrasive material capable of sharpening a blade.

5. The sharpening device of claim 1, wherein at least said exterior surface of said first leg and said second leg are comprised of an abrasive material capable of sharpening a blade.

6. The sharpening device of claim 1, where an interior space enclosed by said base, said apex in said first and said second legs are comprised of a solid material.

7. The sharpening device of claim 6, wherein said solid material has an abrasive exterior surface.

8. The sharpening device of claim 1, further comprising an aperture positioned proximate to said apex, said aperture operatively sized to receive a lanyard chord for removably attaching said sharpening device to an object.

9. The sharpening device of claim 1, wherein said angle modulation means comprises a projection extending downward from said base of said sharpening device and defining two equivalent second angles extending from said first and second ends, wherein when said sharpening device is positioned on said second end said first leg is oriented at a composite third angle which is equivalent to the orientation of said second leg when said sharpening device is resting on said first end.

10. The multi-angled sharpening device of claim 9, wherein said second angles are between about 5 degrees and 25 degrees.

11. The multi-angled sharpening device of claim 9, wherein said composite third angle is between about 15 degrees and 30 degrees.

12. The sharpening device of claim 1, wherein said angle modulation means comprises a projection means extending downward from said base a predetermined length, wherein when said sharpening device is modulated to a first sharpening position said sharpening device is supported by said projection means and said first end and when said device is modulated to a second sharpening position said sharpening device is supported by said projection means and said second end.

13. The sharpening device of claim 12, wherein said projection means further comprises adjustment means, wherein the total length of said projection means extending downward from said base may be modified.

14. The sharpening device of claim 12, wherein a first end of said projection means is threaded to operably engage a threaded aperture positioned in said base of said sharpening device.

15. The sharpening device of claim 12, wherein said projection means has a length extending from said base of about 0.5 inches, wherein when said sharpening device is in either said first or said second sharpening position said first leg and said second leg are oriented at an angle between about 15 and 30 degrees when measured from a vertical plane of reference.

16. The multi-angle sharpening device of claim 1, further comprising a V-shaped groove extending from said apex to proximate said base, said groove operatively angled to facilitate the sharpening of fishhooks and other similar shaped objects.

17. The multi-angled sharpening device of claim 1, wherein said sharpening device can be supported entirely on said first leg or said second leg to facilitate the sharpening of a metallic object on an opposing leg of said multi-angled sharpening device.

18. The multi-angled sharpening device of claim 1, further comprising a handle interconnected to said sharpening device proximate to said apex.

19. A multi-angled sharpening device, comprising:

(a) a first leg having an upper end and a lower end lying in a first plane;

(b) a second leg having an upper end and a lower end lying in a second plane, said first and said second planes oriented to define a first angle; and (c) a base interconnected to said lower end of said first leg at a first end and to said lower end of said second leg at a second end, said base further comprising angle modulation means, wherein said sharpening device may be pivoted between a first sharpening position and a second sharpening position to sharpen a blade on an exterior surface of each of said first leg and said second leg.

20. The sharpening device of claim 19, further comprising a handle interconnected proximate to said upper end of said first leg and said upper end of said second leg, said handle operatively sized for grasping by a user of said sharpening device.

21. The sharpening device of claim 19, wherein said angle modulation means comprises a retractable pin extending downward from said base a predetermined length, wherein when said sharpening device is modulated to a first sharpening position said sharpening device is supported by said projection means and said first end and when said device is modulated to a second sharpening position said sharpening device is supported by said projection means and said second end.

22. The sharpening device of claim 21, wherein said retractable pin further comprises adjustment means, wherein the total length said retractable pin extends downward from said base can be selectively adjusted.

23. A method for sharpening a blade of a knife or other tool using a multi-angled sharpening device, comprising the steps of:

(a) grasping an upper portion of said sharpening device;

(b) supporting a base of said sharpening device on a substantially planar surface;

(c) orienting said sharpening device to a first sharpening position, wherein a first leg of said sharpening device is exposed for use;

(d) drawing a first cutting edge of a blade across said first leg of said sharpening device to sharpen said first cutting edge of said blade;

(e) orienting said sharpening device to a second sharpening position, wherein a second leg of said sharpening device is exposed for use; and (f) drawing a second edge of said blade across said second leg of said sharpening device to sharpen said second cutting edge, wherein said blade becomes sharpened.

* * * * *